US006484740B2

(12) United States Patent
Guthrie

(10) Patent No.: US 6,484,740 B2
(45) Date of Patent: Nov. 26, 2002

(54) BLOWER ASSEMBLY FOR GAS WELLS

(76) Inventor: Clinton Guthrie, 62nd S. Main St., Buffalo, MT (US) 82834

( * ) Notice: Subject to any disclaimer, the term of this patent is extended or adjusted under 35 U.S.C. 154(b) by 57 days.

(21) Appl. No.: 09/782,050

(22) Filed: Feb. 14, 2001

(65) Prior Publication Data

US 2002/0108650 A1 Aug. 15, 2002

(51) Int. Cl.[7] ..... F16L 55/18; E21B 34/02

(52) U.S. Cl. ..... 137/15.03; 137/312; 137/364; 137/377

(58) Field of Search ..... 137/364, 377, 137/382, 15.03, 312

(56) References Cited

U.S. PATENT DOCUMENTS 4,335,740 A * 6/1982 Boley ..... 137/364
5,188,294 A * 2/1993 Sealy et al. ..... 239/310
5,287,927 A * 2/1994 Pass et al. ..... 166/267
5,975,122 A * 11/1999 Hazen et al. ..... 137/382
6,021,804 A * 2/2000 Griffin et al. ..... 137/341

* cited by examiner

*Primary Examiner*—A. Michael Chambers
(74) *Attorney, Agent, or Firm*—Antonelli, Terry, Stout & Kraus, LLP.

(57) ABSTRACT

A preassembled gas well blower assembly includes a platform which supports a blower above the ground. An inlet pipe had an outlet end connected to the blower inlet and extends downwardly through the support surface to an inlet end . An outlet pipe has an inlet end connected to the blower outlet and extends downwardly through the support surface to an outlet end. The preassembled is moved to a position over first and second gas pipeline sections. The inlet pipe inlet end is coupled to the first gas pipeline section, and the outlet pipe outlet end is coupled to the second gas pipeline section, permitting the blower to cause gas to be blown through the pipeline sections.

12 Claims, 4 Drawing Sheets

BLOWER ASSEMBLY FOR GAS WELLS

FIELD OF THE INVENTION

The present invention pertains to a blower assembly for gas wells and to a method of coupling a gas blower to a gas pipeline. More particularly, the present invention pertains to an improved blower assembly which can be easily and inexpensively installed and which minimizes the amount of above-ground piping and other components and also permits those above-ground components to be protected from the outdoor elements so as to minimize exposure to extreme weather conditions.

BACKGROUND OF THE INVENTION

Much gas is produced from natural and coalbed methane gas fields. A blower is usually utilized to move the gas through the gas pipelines. The temperatures in such gas fields might run to well over 100° F. during the summer and to lower than −50° F. during the winter. The gas flows twenty-four hours a day year around. Consequently, the blower must be capable of long run times under extreme weather conditions. The blower must also be easy and inexpensive to install and to maintain.

SUMMARY OF THE INVENTION

The present invention is an improved gas blower assembly particularly suited for gas fields to move gas through pipelines and to a method of coupling a gas blower to a gas pipeline. In a preferred embodiment of the present invention, a preassembled gas well blower assembly includes a platform having a support surface above a surface of the ground. A blower is supported on the support surface and has an inlet and an outlet. An inlet pipe has an outlet end connected to the blower inlet and extends downwardly through the support surface to an inlet end adapted to be coupled to a first gas pipeline section to receive gas therefrom. An outlet pipe has an inlet end connected to the blower outlet and extends downwardly through the support surface to an outlet end adapted to be coupled to a second gas pipeline section to provide gas thereto. The platform, with the blower supported thereon and having the inlet pipe and the outlet pipe connected thereto, can be positioned over first and second gas pipeline sections and coupled thereto to permit the blower to cause gas to be blown through the pipeline sections.

In a second embodiment, the inlet pipe extends horizontally from the wellbox to a gas pipeline extending from the wellhead, which can also be within a wellbox. Since at most only minimal pipes are exposed to the ambient conditions, the hazards of freezing and of exposed gas pipe are significantly reduced. The overall height of the assembly allows the assembly to be easily enclosed within a standard wellbox, such as a fiberglass insulated box.

A preferred embodiment of the method of coupling a gas well blower to a gas pipeline in accordance with the present invention includes preassembling a gas well blower assembly including a platform having a support surface which are above a surface of the ground, a blower supported on the support surface and having an inlet and an outlet, an inlet pipe having an outlet end connected to the blower inlet and extending downwardly through the support surface to an inlet end, and an outlet pipe having an inlet end connected to the blower outlet and extending downwardly through the support surface to an outlet end. The gas well blower assembly is moved to a position over first and second gas pipeline sections. The inlet pipe inlet end is coupled to the first gas pipeline section to permit said inlet pipe inlet end to receive gas from the first gas pipeline section, and the outlet pipe outlet end is coupled to the second gas pipeline section to permit the outlet pipe outlet end to provide gas to the second gas pipeline section, and so to permit the blower to cause gas to be blown through the pipeline sections.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings:

DETAILED DESCRIPTION OF PREFERRED EMBODIMENTS

Figure 1:
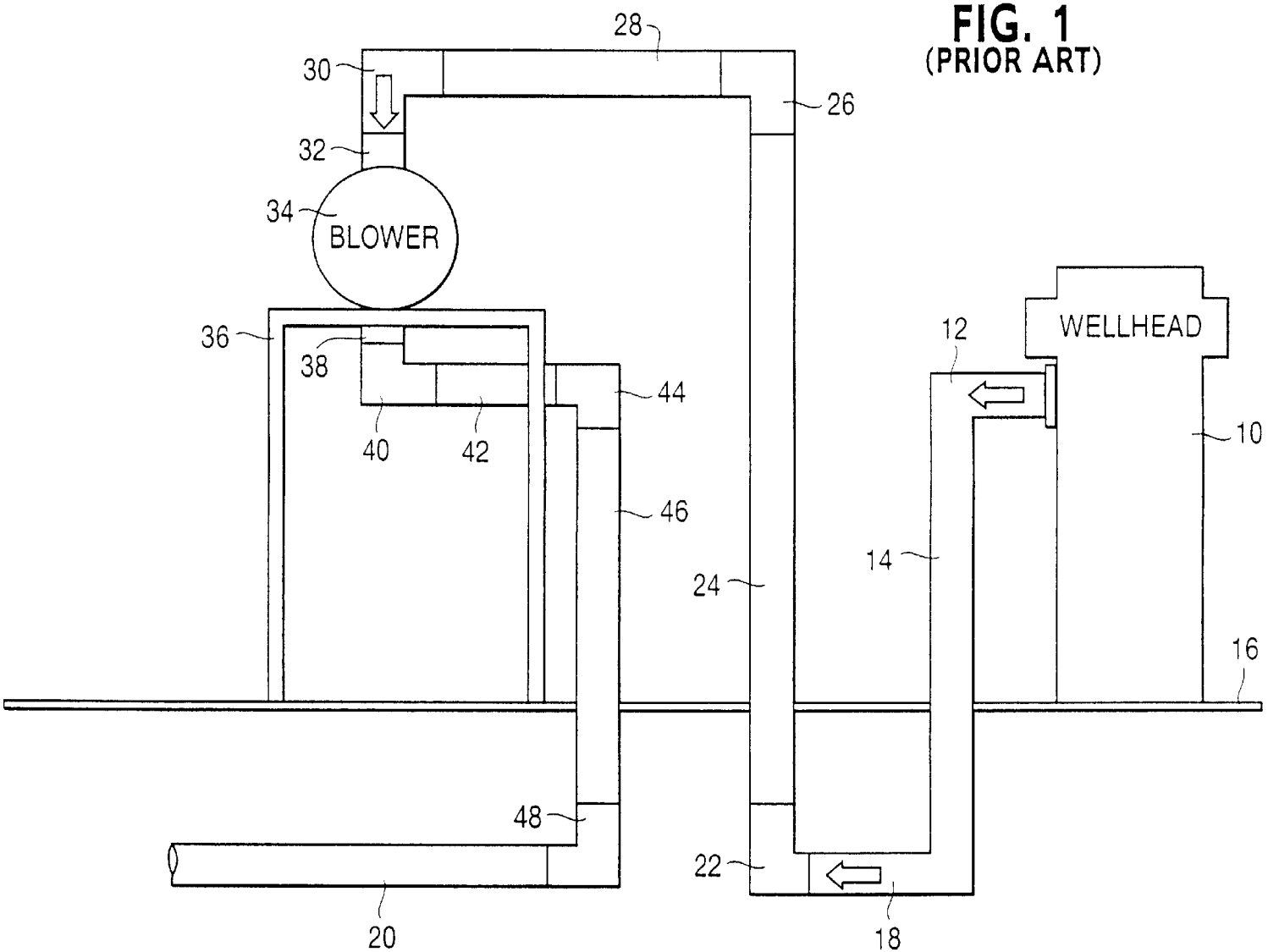
FIG. 1 (PRIOR ART)
FIG. 1 is a schematic representation of a prior art well gas blower assembly.

FIG. 1 is a schematic representation of a prior art well gas blower assembly typical of those frequently found at gas wells. At such a gas well, a wellhead 10 has a outlet pipe 12 coupled to it. Typically this is above ground and leads to a downwardly extending pipeline portion 14 which continues below the surface 16 of the ground. Below the ground, the pipeline turns to run in a horizontal pipeline section 18. If no blower assembly is provided, that horizontal section 18 is directly coupled to a continuing horizontal underground pipeline section 20. Typically, however, a blower assembly is installed. In such a prior art installation, a portion of the horizontal pipeline sections 18, 20 is removed to permit installation of the blower assembly. A first elbow pipe 22 is connected to the first pipeline section 18. A vertically extending pipeline section 24 is then attached to the second end of elbow 22. A second elbow 26 connects the upper end of pipeline section 24 to a horizontal pipeline section 28. A third elbow 30 couples section 28 to a downwardly extending pipeline section 32 which is then connected to blower 34. Blower 34 typically sits on a metal frame 36 at a distance above the ground, for example X feet above the ground. A vertical pipeline section 38 extends from the outlet of blower 34, through frame 36 to another elbow 40. Elbow 40 connects to a horizontal section 42 which passes through frame 36 to a further elbow 44. Elbow 44 connects to a downwardly extending pipeline section 46 which connects to an elbow 48 that joins the blower assembly to second pipeline section 20.

Blower 34 is powered by an appropriate motor and draws gas from wellhead 10 through the various pipeline sections and then forces that gas through the further pipeline sections to underground pipeline section 20 through which the gas flows to a further destination. All of the elements of this prior art blower assembly are above ground and are exposed to the ambient weather conditions. Typically pipeline section 28 might be seven feet above ground, making it impractical to enclose the blower assembly in an inexpensive wellbox. As a consequence, all of these elements are generally exposed to extreme weather conditions. In addition, the numerous elbow connections all are welded to the adjacent pipeline sections. As a consequence, considerable time and effort is required to install such a blower assembly. Often the installation expense was greater than the cost of the blower assembly materials.

Figure 2:
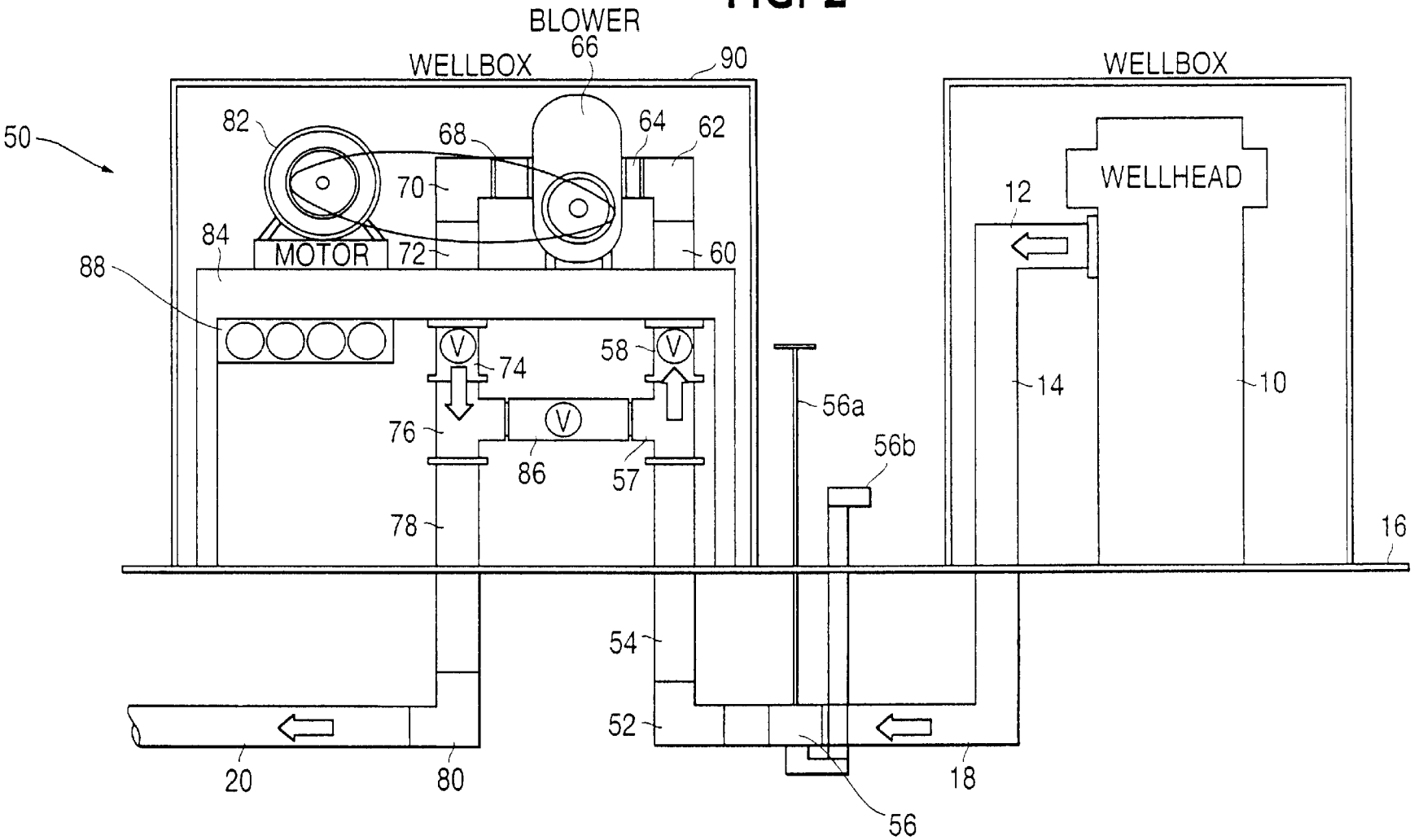
FIG. 2 is a schematic representation of a well gas blower assembly in accordance with a preferred embodiment of the present invention.

FIG. 2 is a schematic representation of a blower assembly 50 in accordance with a preferred embodiment of the present invention. Again, wellhead 10 is connected to an outlet pipe 12 which includes a downwardly extending section 14 that leads to underground pipeline section 18. Section 18 is coupled to an elbow 52 which joins to an upwardly extending pipeline section 54. Preferably, a water removal stinger 56 is provided between pipeline section 18 and elbow 52 to permit removal of water and condensation from the pipeline.

Vertical section 54 is connected to a flanged Tee section 57 which, in turn, is connected by a full port ball valve 58 to a further vertical section 60. Section 60 is connected by elbow 62 to a collar 64 that connects to the inlet of a blower 66. Collar 68 connects the outlet of blower 66 to elbow 70, the outlet of which is coupled by pipe section 72 to a check valve 74 which prevents backup of gas into the blower outlet. The outlet of check valve 74 is coupled by a Tee section 76 to a vertical pipe section 78 which extends below the surface of the ground to an elbow 80 which joins to underground pipeline section 20.

Blower 66 is powered by a motor 82, for example a three phase electric motor. Blower 66 and motor 82 are supported above the ground on the support surface of a platform 84. A full port ball valve 86 joins Tee sections 57 and 76, coupling inlet Tee pipe section 57 with outlet Tee pipe section 76, and so permitting bypassing of blower 66 during maintenance. Preferably, a meter panel 88 is provided and includes meters such as an inlet pressure gauge, an outlet pressure gauge, an oxygen gauge, and a temperature gauge. These several gauges are connected to appropriate sensors and preferably are able to control valves 58, 74, and 86 and controls to shut down the blower assembly in the event of an inappropriate pressure buildup, unsafe accumulation of oxygen, or excessive temperature.

All of the above ground components are positioned within a wellbox 90, which is preferably insulated so that heat resulting from operation of motor 82 and blower 66 maintains a safe temperature around all of the blower assembly during cold extremes. Preferably also, that wellbox is louvered so that during warm weather conditions the interior of the wellbox is vented, avoiding excessive heat buildup.

Blower assembly 50 is preassembled and moved to the location at which it is to be installed, for example adjacent wellhead 10. Inlet Tee pipe section 57 is coupled to the first gas pipeline section 18, and outlet Tee pipe section 76 is coupled to second gas pipeline section 20. As depicted in FIG. 2, pipeline sections 54 and 78 can be utilized to complete the coupling. The necessary electrical and other connections are made to complete the installation, including water removal stinger 56 if provided, and motor 82 is activated to power blower 66, causing gas to flow from wellhead 10 through pipeline sections 18 and 20.

Figure 3:
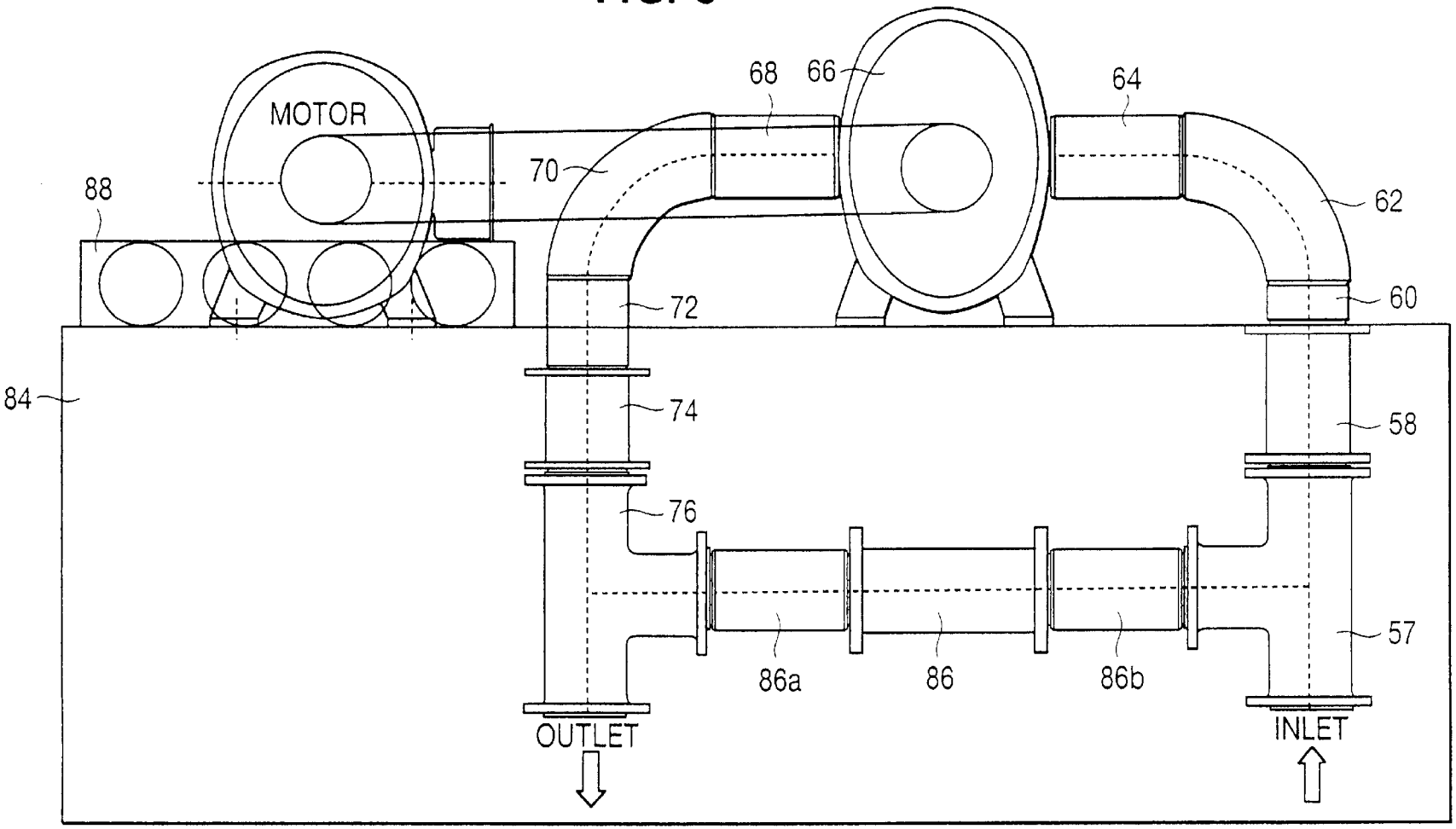
FIG. 3 is a detailed schematic diagram am of the components of the well gas blower assembly of FIG. 2.

FIG. 3 is an enlarged schematic of the components of the present invention as illustrated in FIG. 2 as utilized in one implementation of the present invention. By way of example, the various components can be four inches in internal diameter.

Figure 4:
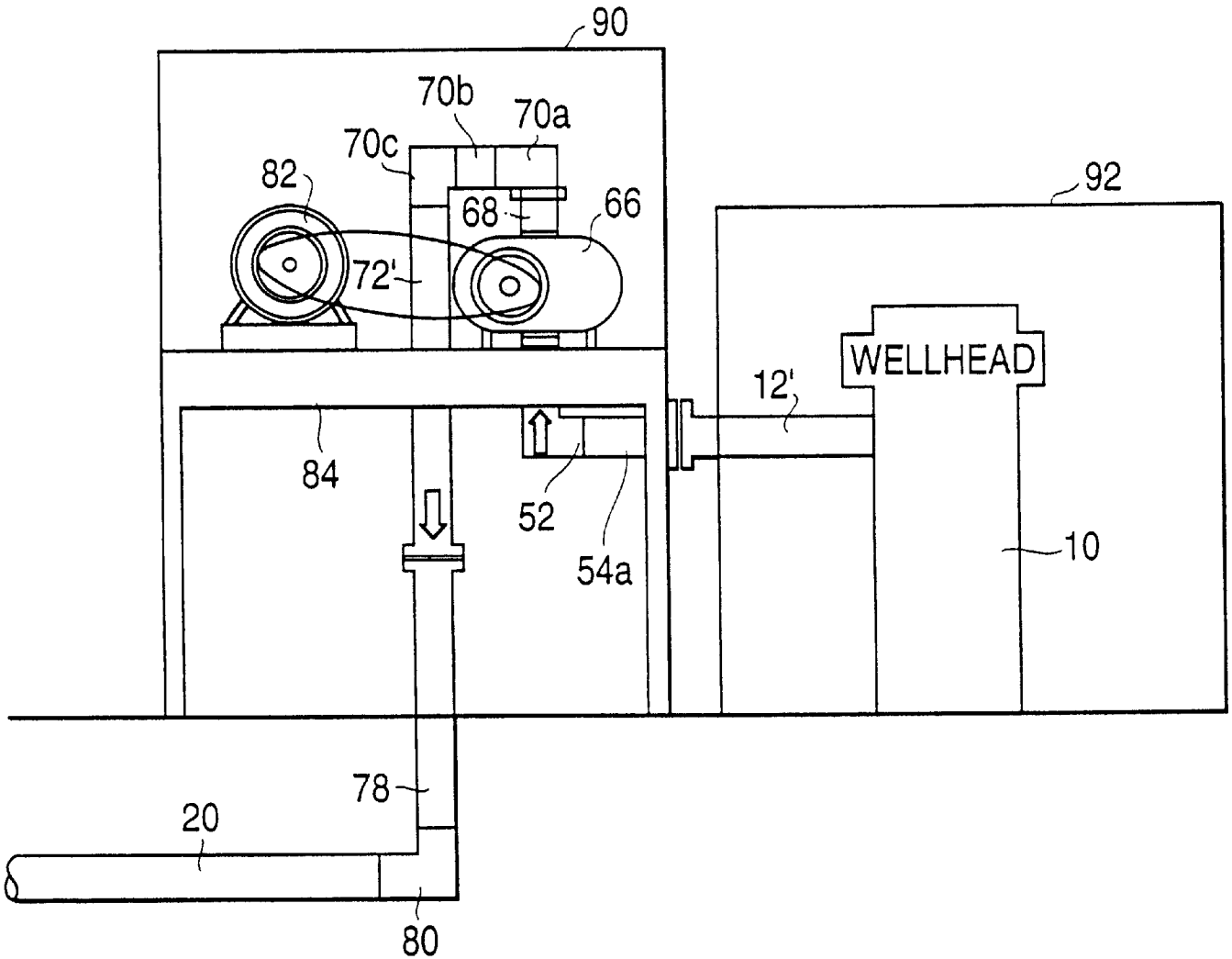
FIG. 4 is a schematic diagram of an alternative embodiment of a well gas blower assembly in accordance with the present invention.

FIG. 4 is a schematic representation of an alternative embodiment of a blower in accordance with the present invention. Outlet pipe 12' from wellhead 10 extends horizontally to a horizontal inlet pipe **54*a* that passes through wellbox 90 and frame 84 to elbow 52, the outlet of which is coupled to blower 66. The outlet of blower 66 is coupled by collar 68, elbow 70*a*, pipelines section 70*b* and elbow 70*c* to a vertically extending section 72' that is joined to pipeline section 78. The outlet of section 78 is coupled by elbow 80 to underground horizontal pipeline section 20. This embodiment can include ball valves and a check valve such as valves 58, 74, and 86 of the embodiment of FIG. 2, as well as meters 88 and a water removal stinger. Wellhead 10 can be enclosed within a wellbox 92 both in the embodiment of FIG. 2 and in the embodiment of FIG. 4. As a consequence, only a small distance of pipeline between wellbox 90 and wellbox 92** is exposed to the ambient weather conditions.

The present invention has been found to greatly improve the ease with which a blower assembly is connected to a gas pipeline from a gas wellhead. The assembly of FIG. 2, by way of example, can be accommodated within a wellbox 90 four feet tall, four feet wide and six feet long. The assembly as depicted in FIG. 3 can be fabricated ahead and brought to the wellhead site or other location at which it is to be installed so that it then can be installed in place by simply removing a portion of pipeline sections 18, 20 and attaching elbows 52 and 80 and pipe sections 54 and 78, as well as water removal stinger 56 if desired. These components need not be welded and so the installation can be rapidly accomplished.

Although the present invention has been described with reference to preferred embodiments, those skilled in the art will appreciate that rearrangements, alterations, and substitutions can be made, and still the result would be within the scope of the invention.

What is claimed is:

1. A method of coupling a gas well blower to a gas pipeline, said method comprising the steps of:

(a) preassembling a gas well blower assembly including a platform having a support surface above a surface of the ground, a blower supported on said support surface and having an inlet and an outlet, an inlet pipe having an outlet end connected to said blower inlet and extending downwardly through said support surface to an inlet end, and an outlet pipe having an inlet end connected to said blower outlet and extending downwardly through said support surface to an outlet end;

(b) moving said gas well blower assembly to a position over first and second gas pipeline sections; and (c) coupling said inlet pipe inlet end to the first gas pipeline section to permit said inlet pipe inlet end to receive gas from the first gas pipeline section; and (d) coupling said outlet pipe outlet end to the second gas pipeline section to permit said outlet pipe outlet end to provide gas to the second gas pipeline section, and so permit said blower to cause gas to be blown through the pipeline sections.

2. A method as claimed in claim 1, further comprising placing a wellbox over the gas well blower assembly.

3. A method as claimed in claim 1, wherein step (c) comprises coupling said inlet pipe inlet end to a downwardly extending pipe section, and coupling said downwardly extending pipe section to the first gas pipeline section at a point below the surface of the ground.

4. A method as claimed in claim 1, wherein step (c) comprises coupling said inlet pipe inlet end to a horizontally extending pipe section extending from beneath said platforrn, and coupling said horizontally extending pipe section to the first gas pipeline at a point above the surface of the ground.

5. A method as claimed in claim 1, further comprising installing a water removal stinger between said first gas pipeline section and said inlet pipe inlet end.

6. A preassembled gas well blower assembly, comprising:

a platform having a support surface above a surface of the ground;

a blower supported on said support surface and having an inlet and an outlet;

an inlet pipe having an outlet end connected to said blower inlet and extending downwardly through said support surface to an inlet end adapted to be coupled to a first gas pipeline section to receive gas therefrom; and an outlet pipe having an inlet end connected to said blower outlet and extending downwardly through said support surface to an outlet end adapted to be coupled to a second gas pipeline section to provide gas thereto, whereby said platform, with said blower supported thereon and having said inlet pipe and said outlet pipe connected thereto, can be positioned over first and second gas pipeline sections, and said inlet pipe and said outlet pipe can be coupled to the first and second gas pipeline sections to permit said blower to cause gas to be blown through the pipeline sections.

7. An assembly as claimed in claim 6, further comprising a wellbox having said platform, said blower, said inlet pipe, and said outlet pipe therein.

8. An assembly as claimed in claim 6, wherein said inlet pipe extends vertically into the ground to the first gas pipeline section.

9. An assembly as claimed in claim 6, wherein said inlet pipe extends horizontally from beneath said platform to the first gas pipeline section.

10. An assembly as claimed in claim 6, further comprising a valve coupling said inlet pipe and said outlet pipe and operable to provide a bypass path around said blower.

11. An assembly as claimed in claim 6, further comprising a check valve in said outlet pipe and operable to prevent gas in said outlet pipe from returning to said blower.

12. An assembly as claimed in claim 6, further comprising a water removal stringer in said inlet pipe to permit removal of water from said inlet pipe.

* * * * *